United States Patent [19]

Blum et al.

[11] 4,398,914

[45] Aug. 16, 1983

[54] PROCESS FOR DISCHARGE OR RESERVE PRINTING ON SYNTHETIC FIBERS: FORMALDEHYDE SULFOXYLATE AND HEXAMETHYLENE TETRAMINE

[75] Inventors: Adolf Blum; Peter Kutschera; Guenther Vogl, all of Ludwigshafen, Fed. Rep. of Germany

[73] Assignee: BASF Aktiengesellschaft, Ludwigshafen, Fed. Rep. of Germany

[21] Appl. No.: 346,740

[22] Filed: Feb. 8, 1982

[30] Foreign Application Priority Data

Feb. 19, 1981 [DE] Fed. Rep. of Germany ..... 3106036

[51] Int. Cl.[3] ..... D06P 5/15

[52] U.S. Cl. ..... 8/456; 8/464; 8/587; 8/592; 8/602; 8/531; 8/921; 8/922; 8/924

[58] Field of Search ..... 8/456, 464, 592, 587, 8/602

[56] References Cited

U.S. PATENT DOCUMENTS

| | | | |
|---|---|---|---|
| 2,874,022 | 2/1959 | Raff et al. | 8/461 |
| 3,097,045 | 7/1963 | Bartl et al. | 8/453 |
| 3,972,677 | 8/1976 | Feess et al. | 8/464 |
| 4,265,629 | 5/1981 | Ribka et al. | 8/532 |

*Primary Examiner*—A. Lionel Clingman

*Attorney, Agent, or Firm*—Bernhard R. Swick; Andrew E. Pierce

[57] ABSTRACT

Process for printing on synthetic fibers of polyester, triacetate, acetate and polyamide and mixtures of these fibers with dispersion dyes according to the discharge or discharge resist process, where a mixture of the following substances is used as a discharging agent:

(a) 5 to 50 parts by weight of a compound having formula

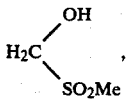

(I)

in which Me=Na, K, $NH_4$ and alkyl substituted ammonium groups or an ammonium derivative which contains at least one radical derived from an alkali metal or ammonium salt of methane sulfinic acid, (b) 5 to 50 parts by weight of hexamethylene tetramine and (c) 0 to 20 parts by weight of anthraquinone.

10 Claims, No Drawings

PROCESS FOR DISCHARGE OR RESERVE PRINTING ON SYNTHETIC FIBERS: FORMALDEHYDE SULFOXYLATE AND HEXAMETHYLENE TETRAMINE

BACKGROUND OF THE INVENTION

1. Field of the Invention

This invention relates to a method for printing with dispersion dyes various synthetic fibers by a discharge or discharge resist process.

2. Description of the Prior Art

In German Pat. No. 10 86 209 printing pastes are described for the direct or discharge printing processes on textiles of new or regenerated cellulose, natural silk or linear polyamides. Dyestuffs employed for this process are vat and/or sulfur dyes. In addition to this "discharge resist" processes are known where either tin-(II)-chloride or the zinc salt of hydroxymethane sulfinic acid are used as discharging agents. The drawback of tin-(II)-chloride is that it releases hydrochloric acid during the dyeing process at temperatures above 100° C. This results in pronounced corrosion in the steamers in which the imprinted goods are heat treated. The use of the zinc salt of hydroxymethane sulfinic acid is not without its detriments either since the dyestuffs which are required for the color printing of the good are stable for a limited amount of time only. This often results in the production of rejects.

German Pat. No. 27 53 696 describes a process which does not have these drawbacks, however, this process can be used only for "discharge resist" printing. In the "discharge" printing process, pre-dyed goods are used, that is, the dye for the background is already fixed. The pre-drying results in more uniform surfaces and is also advantageously used with knitted goods which pose particular padding problems for technical reasons.

SUMMARY OF THE INVENTION

The purpose of the invention is to make available a process for printing synthetic fabrics comprising fibers of polyester, cellulose triacetate, cellulose acetate and polyamide as well as mixtures of these fibers with dispersion (disperse) dyes according to the "discharge" or "discharge resist" processes which can be handled safely, causes essentially no corrosion in the steamers, and is suited equally well for the discharge as well as for the discharge resist process.

In accordance with this invention, this purpose is achieved by using as the discharging agent a mixture of (a) 5 to 50 parts by weight of a compound having the following formula

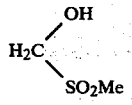

(I)

in which Me is selected from the group consisting of Na, K, $NH_4$, alkyl substituted ammonium groups, and ammonia derivatives which contain at least one radical of an alkali metal or ammonium salt of methane sulfinic acid, (b) 5 to 50 parts by weight of hexamethylene tetramine and (c) 0 to 20 parts by weight of anthraquinone 1000 parts by weight of the printing paste contain 10 to 150 parts by weight of said discharging agent mixture.

DETAILED DESCRIPTION OF THE INVENTION

According to the process of this invention, textiles such as woven or knitted goods of polyester, cellulose triacetate, cellulose acetate and polyamide or mixtures of these fibers are imprinted. Textiles of said fiber types are well known in the art. Dispersion dyes are used almost exclusively as dyestuffs. The discharge resist process can be implemented in such a manner that the textile material is initially padded with a liquor containing a dischargeable dye. Instead of padding, the textile goods can also be printed with a printing paste which contains a dischargeable dye. The textile material is then dried under such conditions that the dyes are not yet fixed. Following this step, the textile material is printed with a mixture of discharge resistant dye and the discharge agent and is dried. Subsequently the dyes are fixed, for instance, by way of the thermosol process or by heating the textiles in a hot steam atmosphere. Under these conditions, the dischargeable dye is destroyed in those areas to which the mixture of the discharge resistant dye and the discharge agent were printed. This mode of operation is referred to as discharge resist printing since the background of the goods is dyed but the dye itself is not yet fixed.

A variation of the discharge resist process consists of printing the mixture of discharge resist dye and reduction agent onto the textile goods directly after which the dischargeable dye is completely printed over. The material is subsequently dried and the dyestuffs are fixed. In discharge printing, a dischargeable dye which is already fixed on the fabric is discharged in accordance with the desired pattern using the mixture of discharging agent. With variations on these processes it is also possible to discharge-white print, that is, in this case a printing paste is used which contains the discharging mixture but no dyes.

In the case of polyester fabrics, the dyeing process may be implemented by using carriers as well as high temperature conditions such as dyeing under pressure in aqueous liquors at 120° C. The reductive post cleaning process required for polyester fabrics takes place after printing and fixing, that is, the background and the areas imprinted for the illumination are reductively cleaned in one process. The advantage of this type of dyeing lies in the better uniformity of the background which is particularly important when the pattern requires only individual small areas to be discharged. Especially as far as knitted goods or very light fabrics are concerned, the preliminary dyeing brings about qualitative advantages. Synthetic fibers of acetate or polyamide and/or their mixtures are dyed at a temperature of 85° C.

As already mentioned, dispersion dyes are used for the process according to this invention on an almost exclusive basis. Suitable dyes of this type may be found in the Color Index. Dischargeable dispersion dyes are those which are decomposed into colorless components by the discharging agent. These are primarily dispersion dyes which are derived from azo dyes. The discharge resistant dyes are primarily dispersion dyes based on anthraquinone derivatives. These dyes are resistant to the discharging agent.

The discharging agent mixture to be used in the process according to this invention contains 5 to 50 parts by weight of sodium formaldehyde sulfoxylate, the corresponding ammonium or alkyl-substituted ammonium compound and/or potassium compound, or an ammonia derivative which contains at least one radical of an alkali metal or an ammonium salt of methane sulfinic acid. Compounds of this type are obtained by substituting one or more of the hydrogen atoms of ammonia or an ammonium derivative, for instance, primary or secondary amines such as mono- or diamines such as methylamine, dimethylamine, isopropylamine, n-butylamine or ethylene diamine, or of hydrazine or urea, said hydrogen atoms being bonded to a nitrogen atom by the radical having the general formula $$-CH_2-SO_2Me \qquad \text{(II)}$$

in which Me is an alkali metal or an ammonium group. The ammonium derivatives are produced in a known manner, for instance, by reacting ammonia or ammonium derivatives containing at least one hydrogen atom bonded to nitrogen with alkali metal or ammonium salts of hydroxymethane sulfinic acid (compounds in formula I). This reaction takes place by removing water. Preferably used are the sodium and potassium salts of the ammonium derivatives of methane sulfinic acid. The ammonium grouping in formula II can also be derived from amines. Preferably used are the sodium salt of nitrilomethane sulfinic acid having the formula $$N(CH_2SO_2Na)_3$$

which is produced by reacting ammonia with hydroxymethane sulfinic sodium in a mole ratio of 1:3 and a compound having the formula $$H_2N-CH_2-SO_2Na,$$

which is obtained by reacting ammonia with the sodium salt of hydroxymethane sulfinic acid in a mole ratio of 1:1.

The discharging agent mixture contains 5 to 50 parts by weight of at least one compound having formula I or an ammonia derivative containing at least one radical of an alkali metal or ammonium salt of methane sulfinic acid as component (a) as well as 5 to 50 parts by weight of hexamethylene tetramine as component (b). In order to discharge dyed textiles which were dyed with a dischargeable dispersion dye, those mixtures of discharging agents are preferably used which contain up to 20 parts by weight of anthraquinone in addition to components (a) and (b).

As a rule, the printing paste in which the discharging agent is applied to the textile material contains thickeners in order to adjust the viscosity. Preferably used are natural thickeners such as starch ethers, starch-tragacanth thickeners and alginates. 1000 parts of the finished printing paste can contain 20 to 100 parts by weight of the natural thickener. It is also possible to use synthetic thickeners. In thise case, however, greater quantities are required owing to the electrolyte content of the discharge printing paste. Suitable synthetic thickeners include, for instance, high molecular polycarboxylic acids such as polyacrylic acid as well as copolymerizates of ethylene and acrylic acid or copolymerizates of styrene and maleic anhydride. The synthetic thickeners develop their effectiveness in the pH area above 6. Mixtures of natural and synthetic thickeners can also be used.

The printing paste containing the discharging agent contains at least one discharge resistant dispersion dyes. Discharge resistant dispersion dyes are disclosed, for instance, in the Color Index. Several discharge resistant dispersion dyes will be cited in the following by way of example:

Yellow dispersion dye CI 58 900 and CI 47 023,
Orange dispersion dye CI 60 700,
Red dispersion dye CI 60 755, CI 62 015 and CI 60 756,
Violet dispersion dye CI 61 105,
Blue dispersion dye CI 61 500, CI 62 500 and CI 63 285.

The above-referenced dyes are dispersion dyes based upon anthraquinone derivatives. 1000 parts by weight of the printing paste contain 0.5 to 50 parts by weight of a dispersion dye or a mixture of dispersion dyes.

The printing pastes containing the discharging agent can also contain commonly used additives such as urea, fixing agents, foam inhibitors, polyglycol, glycerine and alkali donors which liberate alkalies during the fixing process such as sodium or potassium bicarbonate or the sodium salt of trichloroacetic acid.

Suitable dischargeable dispersion dyes may also be found in the Color Index. These are primarily azo dyes. Examples include the yellow dispersion dye CI 11 855, red dispersion dyes CI 11 150 and CI 11 115.

The following examples illustrate the various aspects of the invention. The parts referred to in the examples are parts by weight. All temperatures are in degrees centigrade unless otherwise noted. The data in percent are relative to the weight of the substances.

EXAMPLE 1

A mixed fabric of 65 percent 2½-acetate and 35 percent by weight polyamide is dyed in an aqueous liquor containing 5.5 percent by weight of a blue dispersion dye having the formula

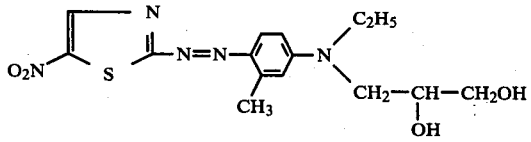

1.5 percent by weight of the yellow dispersion dye CI 11 855 and 1.25 percent by weight of the red dispersion dye 11 115 at 90° C. in accordance with the exhaust process. Subsequently the fabric is rinsed and dried. A black coloration is obtained with the dyestuffs having been fixed. In accordance with the desired pattern, a printing paste having the following composition is printed upon the textile goods dyed as outlined above:

| | |
|---|---|
| 500 | grams starch ether thickener pH 7 (80 grams starch ether in 1000 g water) |
| 30 | grams sodium salt of nitrilomethane sulfinic acid |
| 20 | grams hexamethylene tetramine |
| 10 | grams anthraquinone |
| 50 | grams polyethylene glycol (molecular weight 200 to 300) |
| 20 | grams sodium salt of trichloroacetic acid |
| 50 | grams red dispersion dye CI 62 015 |
| 320 | grams water |
| 1000 | grams |

The printed material is dried and is subsequently treated at a temperature of 102° C. under normal pressure for a period of 20 minutes. Following this process, it is rinsed cold. It is suds rinsed and dried at 30° to 40° C. A deep pink print on a black background is obtained.

EXAMPLE 2

A fabric of polyester is padded with a liquor containing the following components:

60 grams/liter of the dischargeable blue dyestuff having the formula

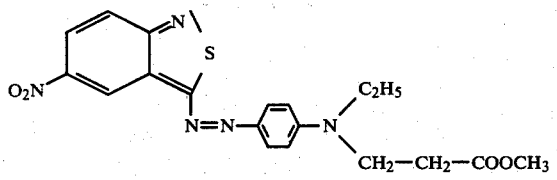

2 grams/liter of a copolymerizate consisting of 75 percent by weight acrylic acid and 25 percent by weight acrylamide which is partially neutralized with sodium hydroxide solution 3 grams/liter of alginate and 10 grams/liter of the sodium salt of nitrobenzene sulfonic acid.

The pH value of the padding liquor is adjusted to 5.5 by means of tartaric acid. Liquor absorption amounts to 70 percent by weight. After padding, the fabric is dried at a temperature in the range of 90° to 100° C. and is then printed according to a pattern using a printing paste having the following composition:

| | |
|---|---|
| 400 | grams starch ether thickener (80 percent aqueous solution) |
| 100 | grams starch ether thickener (10 percent aqueous solution) |
| 40 | grams sodium formaldehyde sulfoxylate |
| 20 | grams hexamethylenetetramine |
| 10 | grams oleic acid diethanolamide |
| 40 | grams urea |
| 10 | grams sodium bicarbonate |
| 40 | grams red dispersion dye having formula 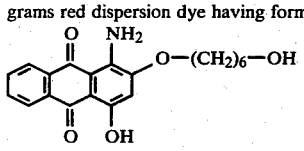 |
| 340 | grams water |
| 1000 | grams |

The printed material is dried and is subsequently treated with super-heated steam under normal pressure at a temperature of 175° C. for a period of 8 minutes. Following this, the material is rinsed as usual and is cleaned reductively. A pink print on a blue background is obtained.

When printing a fabric which has already been dyed with the referenced dischargeable dye (that is, the dyes are already fixed), it will be advantageous to add 10 to 20 grams of anthraquinone to the printing dye per kilogram of printing paste.

While this invention has been described with reference to certain specific embodiments, those skilled in this art will recognize that many variations are possible without departing from the scope and spirit of the invention.

The embodiments of the invention in which an exclusive privilege or property is claimed are defined as follows:

1. In a process for disperse dyeing of a synthetic fabric with dispersion dyes by the discharge or discharge-resist method wherein said fabric is padded or printed respectively with a padding liquor or printing paste containing at least one dischargeable dye; said fabric is dried under conditions which do not result in fixation of the dye, or alternatively said fabric is dried under conditions which result in fixation of the dye; said fabric is printed with a mixture comprising a discharge agent, or alternatively a discharge agent and at least one discharge-resistant dispersion dye; and said dischargeable dispersion dyes are fixed, or where contacted by said discharge agent, destroyed; the improvement wherein said discharge agent comprises a mixture of (A) about 5 to about 50 parts by weight of a compound having the formula:

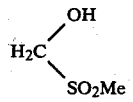

wherein Me is selected from the group consisting of sodium, potassium, ammonium and alkyl-substituted ammonium groups, or an ammonia derivative derived from the reaction of ammonia or of an ammonium derivative containing at least one hydrogen atom bonded to the nitrogen with alkali metal or an ammonium salt of methane sulfinic acid, (B) about 5 to about 50 parts by weight of hexamethylene tetramine, and (C) 0 to about 20 parts by weight of anthraquinone.

2. The process of claim 1 wherein said discharge agent contains 10 to 20 grams of anthraquinone per kilogram of printing paste.

3. The process of claim 1 wherein said discharge-resist process comprises the steps of (A) padding or printing said synthetic fabric with a dischargeable disperse dye, (B) drying but not fixing said dischargeable dye on said fabric, (C) printing a mixture comprising a discharge resistant disperse dye and a discharge agent on said fabric, (D) drying said fabric, (E) fixing said disperse dyes and destroying said dischargeable dye in those areas of said fabric in which said printing mixture is applied.

4. The process of claim 1 wherein said fabric is dyed in accordance with a discharge-resist method by the application of the following process steps:

(A) printing a mixture comprising a discharge resistant disperse dye and a dischage agent on said fabric, (B) drying said fabric, (C) padding or printing said fabric with a dischargeable disperse dye, (D) fixing said discharge resistant dye and simultaneously destroying said dischargeable dye in those areas of said fabric in which said printing mixture is applied.

5. The process of claims 2, 3 or 4 wherein said synthetic fabric comprises fibers of polyester, cellulose triacetate, cellulose acetate, polyamide, or mixtures thereof.

6. The process of claim 5 wherein said printing paste comprises at least one disperse dye and at least one natural or synthetic thickener or mixtures thereof in an aqueous liquid.

7. The process of claim 6 wherein said printing paste comprises at least one discharge agent, at least one discharge resistant disperse dye, and at least one additive selected from the group consisting of urea, fixing agents, foam inhibitors, polyglycol, glycerine, and alkali donors.

8. The process of claim 7 wherein said alkali donors are selected from the group consisting of sodium or potassium bicarbonate and the sodium salt of trichloroacetic acid.

9. The process of claim 8 wherein component (A) of said discharge agent is selected from the group consisting of the sodium salt of nitrilomethane sulfinic acid, sodium formaldeyde sulfoxylate, and mixtures thereof.

10. The process of claim 9 wherein said printing paste contains about 10 to about 150 parts by weight of discharge agent per kilogram of printing paste.

* * * * *